United States Patent [19]

Gable

[11] 4,290,842

[45] Sep. 22, 1981

[54] FELT PAPER ROLLER ASSEMBLY

[76] Inventor: Wilburn K. Gable, 4203 Mt. Ranier St., Dallas, Tex. 75211

[21] Appl. No.: 115,071

[22] Filed: Jan. 24, 1980

[51] Int. Cl.[3] ..... B44C 7/06; E04D 15/06

[52] U.S. Cl. ..... 156/577; 15/256.51; 156/575; 156/579

[58] Field of Search ..... 156/574, 577, 579, 575, 156/523, 524; 15/256.51

[56] References Cited

U.S. PATENT DOCUMENTS

| | | | |
|---|---|---|---|
| 1,192,637 | 7/1916 | Huddleston | 156/577 |
| 1,278,272 | 9/1918 | Wilson | 156/577 |
| 2,937,779 | 5/1960 | Reustle | 156/575 |
| 4,221,628 | 9/1980 | Rosenberg et al. | 156/579 |
| 4,243,468 | 1/1981 | Boyd | 156/577 |

*Primary Examiner*—Michael G. Wityshyn
*Attorney, Agent, or Firm*—Kanz & Timmons

[57] ABSTRACT

A felt paper dispenser and tampers assembly for dispensing and tamping felt paper on a built-up roof in a single operation. The device has a tamping roller which supports the machine and has adjustable conically shaped hubs which grasp a roll of felt paper forward of the tamper roller and dispenses the paper as the device is rolled along the surface to be covered. A solvent is dispensed onto a brush to clean the surface of the tamper roller to provide a smooth, uninterrupted surface for smoothing the paper onto the heated tar in a single motion.

4 Claims, 5 Drawing Figures

FELT PAPER ROLLER ASSEMBLY

DESCRIPTION

Technical Field

This invention relates to apparatus for dispensing and tamping felt paper used on built-up roofs or on other applications where felt paper is employed.

A built-up roof consists of several overlapping layers of bituminous-saturated roofing felt cemented together by bituminous roofing cement which generally comprises either tar or asphalt. The roofing felt is normally supplied in rolls which are about three feet wide and in various weights or thicknesses. The roll of paper has a hollow core generally formed by the paper itself and is formed in a roll about 8 to 12 inches in diameter.

A typical built-up roof will have an insulation core placed flat on the roof which is covered by a first layer of felt paper. Where the paper overlaps, a layer of tar or asphalt is applied with a conventional mop or the like. The tar or asphalt is applied in heated liquid form. When the hot tar or asphalt is applied to the felt paper, the paper becomes heated and the two overlapped sheets of paper are softened and bonded together.

Several layers of felt paper are generally applied, depending on the specifications for the roof. Thus, as layers of paper are applied over previously applied paper, tar is placed between the edges of the layers. The upper layer is sometimes covered with a solid sheet of tar and sometimes gravel or the like is spread over the top of the tar to protect the roofing felt.

Presently the rolls of roofing felt must be manually placed and rolled by hand across the length of the roof. This is a cumbersome and time consuming chore. Furthermore, as the roofing material is rolled out, it must be smoothed in place by using a broom or the like to eliminate wrinkles and air bubbles. Several persons are usually employed in this task since one must work quickly to spread the paper before the tar cools. Often the brooming creates wrinkles and air bubbles as well as fishmouths where the paper is overlapped.

DISCLOSURE OF INVENTION

In accordance with the present invention, a tamping roller is provided which is rotatably secured on an axle within a frame having an upwardly extending handle. The handle is supplied with a pair of hand grips to move the roller so that the roller may smooth out the felt paper as it is dispensed in front of the roller.

A modified form of the invention comprises a pair of movable conically shaped end rollers positioned forward of the tamping roller which are adapted to engage the hollow core of the roofing paper. The end of the paper is pulled under the roller and a single operator walks along dispensing the paper from the rotating conical end rollers and tamping the paper with the tamping roller in a single operation. The end rollers are pivotally and adjustably secured to the frame to accommodate various sizes of rolls.

As the tamping roller is moved forward, it picks up tar and the like. Thus it is desirable to clean the tar from the roller so that is provides a smooth, continuous surface to tamp the paper in place over the hot tar. A brush and solvent distribution system are provided to clean the roller as it moves to provide a smooth surface on the roller.

A primary object of the invention is to provide apparatus for dispensing and tamping a roll of roofing felt paper used in built-up roofs.

A further object of the invention is to provide apparatus which minimizes labor for applying a built-up roof and which will evenly and efficiently dispense the paper along the roof without brooming, fishmouths, wrinkles and air bubbles, thus providing a better roof.

A still further object of the invention is to provide a tamper which will provide a 100% bond uniformly over the roof thus eliminating any spots which would bubble and later crack and cause a leak in the roof.

Other and further objects of the present invention will become apparent upon studying the following description and the drawings annexed hereto.

BRIEF DESCRIPTION OF THE DRAWINGS

Drawings of the invention are annexed hereto so that the invention may be better and more fully understood, in which.

Numerical references are used to designate like parts throughout the various figures of the drawings.

DESCRIPTION OF THE INVENTION

Figure 1:
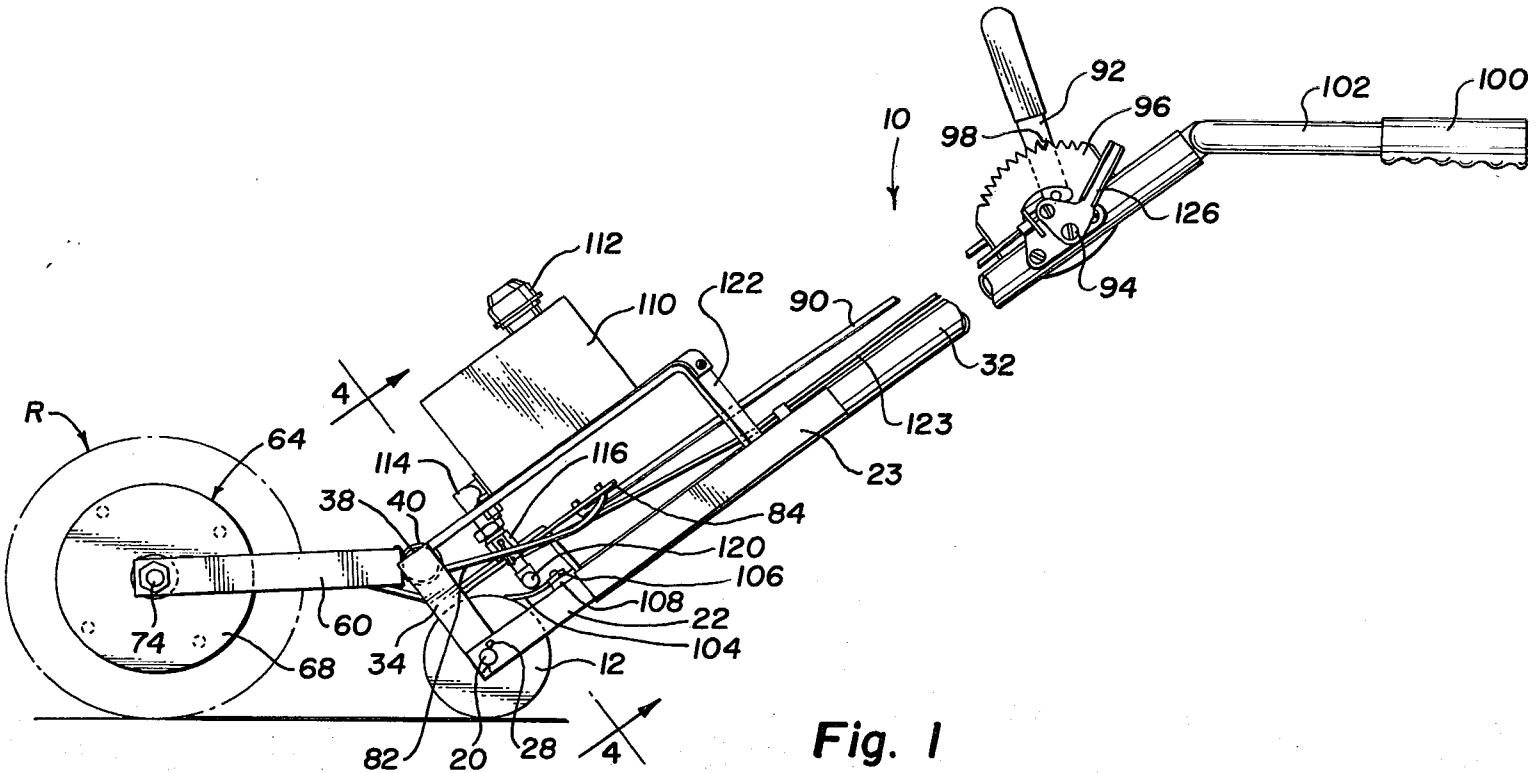
FIG. 1 is a side elevational view of the preferred embodiment of a felt paper dispenser and tamper constructed in accordance with the invention with parts broken away to more clearly illustrate the details of construction.
Figure 2:
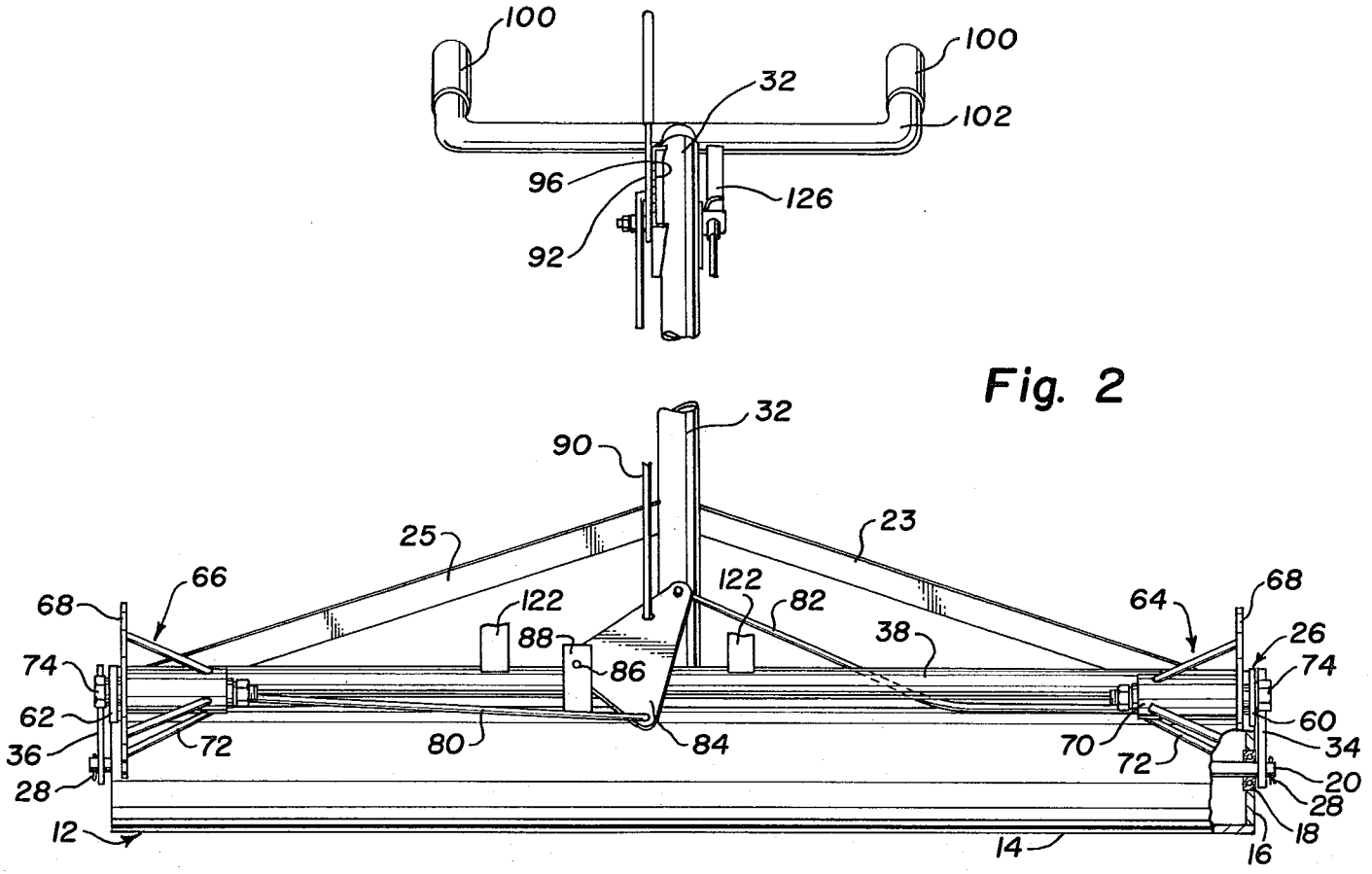
FIG. 2 is an end elevational view thereof.
Figure 3:
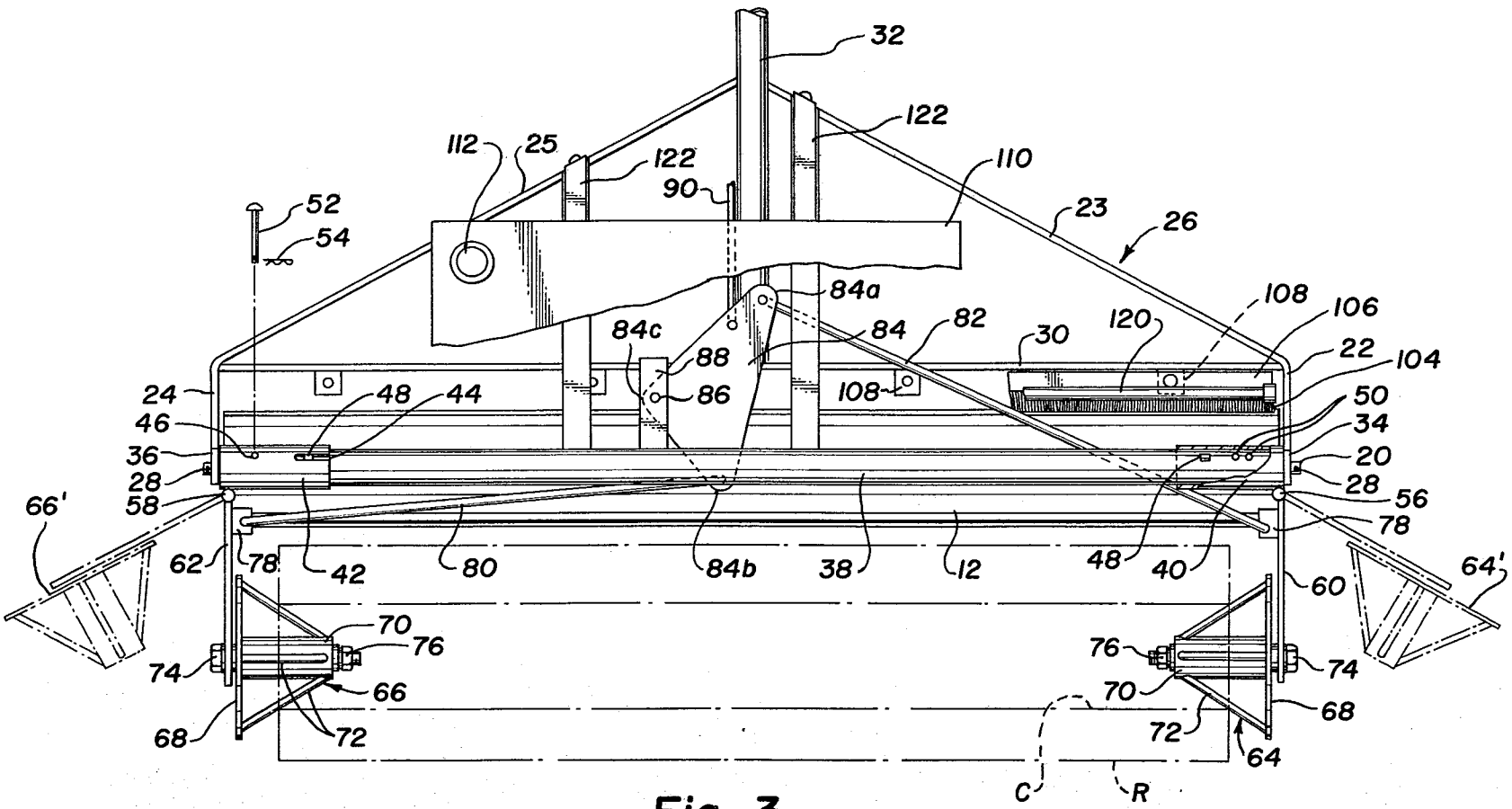
FIG. 3 is a plan view thereof with parts broken away to more clearly illustrate the details of construction.
Figure 4:
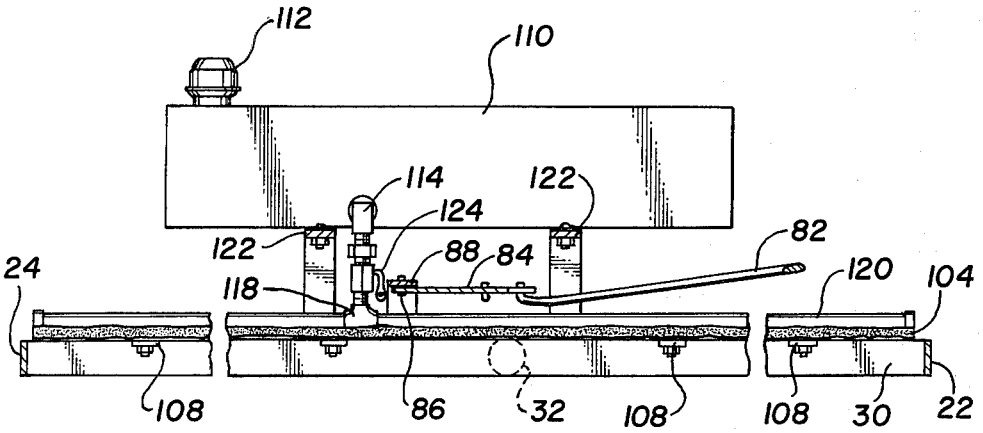
FIG. 4 is a cross sectional view taken along line 4—4 of FIG. 1.

Referring to FIGS. 1 through 4 of the drawings, the dispenser and tamper device is generally designated by the numeral 10. The device 10 is generally adapted to dispense a roll of roofing paper R (shown in dashed outline in FIG. 1) which is generally felt paper constructed of a bituminous material.

Device 10 has a tamper and support roller 12 which generally comprises a hollow cylindrical tube 14 having end plates 16 secured therein with bearings 18 secured centrally in the end plates 16. A shaft 20 is journaled through apertures formed in legs 22 and 24 of the main frame 26 and the bearings 18 to support the roller 12. Roller 12 has a smooth, uninterrupted surface which extends between the legs 22 and 24 of the frame 26. Cotter pins 28 are secured in the ends of shaft 20 to secure the shaft between the legs 22 and 24.

The legs 22 and 24 are joined by a connector member 30. Legs 22 and 24 have portions 23 and 25 which are deflected inwardly and joined with a handle 32 which extends outwardly from member 30.

A pair of support arms 34 and 36 are secured normal to the ends of legs 22 and 24, respectively. A support rod 38 is secured between the support arms 34 and 36 by welding or the like. A pair of adjustment sleeves 40 and 42 are slideaby disposed on the outer ends of rod 38. Each of the sleeves 40 and 42 have slots 44 and apertures 46 formed therein. A lug 48 is welded at each end of support rod 38 to guide the sleeves 40 and 42 longitudinally along rod 38. As slot 44 passes along lug 48, aperture 46 becomes aligned with one of holes 50 formed in each end of rod 38. Pins 52 are positioned in aligned apertures 46 and holes 50 to secure the sleeve 40 or 42 in a fixed position. A hair pin 54 is used to secure pin 52 in place. Movement of sleeves 40 and 42 allows the device to compensate for different sized cores C used on different types and weights of felts.

Adjustment sleeves 40 and 42 have hinges 56 and 58 secured thereto, respectively, which are secured to connecting members 60 and 62. Connecting members 60 and 62 support conically shaped rollers 64 and 66. Rollers 64 and 66 have a circular shaped base 68 and a hub 70 joined by sloping spokes 72. The hub 70 freely rotates on bolt 74 which is journaled through bearings in the ends of hub 70 and secured by nut 76 on the outer end. The connecting arms 60 and 62 and conically shaped rollers 64 and 66 are movable from a first position 64' and 66' spaced outwardly from the frame 26 to a position in front of the frame 26 wherein the ends of the rollers 64 and 66 engage the central core C of a felt roll R. The roll of felt R is freely rotatable with the rollers 64 and 66 on shafts 74.

Support arms 60 and 62 have ears 78 which are joined with connecting rods 80 and 82 secured in apertures formed at opposite ends of a triangular shaped crank 84. Rod 82 is secured in corner 84*a* and rod 80 is secured in corner 84*b*. Corner 84*c* is secured to a pivot pin 86 secured in a support member 88 connected to the frame 26. Control rod 90 is secured along one end of the crank 84 at the lower end and is connected to handle 92 at the upper end. Handle 92 is pivoted on shaft 94 and spring urged against a sawtoothed control flange 96. Tooth 98 on handle 92 engages one of the teeth on control flange 96 to position the handle in the proper location. Thus the depth at which the rollers 64 and 66 engage the core C of roll R is controllable by movement of handle 92. As the handle 92 moves downwardly, the arrangement of the connecting rods 80, 82 and 90 push the conically shaped rollers 64 and 66 outwardly. As the handle 92 is pulled upwardly, the rollers 64 and 66 are pulled inwardly. By positioning pin 52 in one of the various holes 50 in support rod 38 a further adjustment for the diameter of the core C of roll R is provided.

Handle 32 has a pair of grips 100 formed on a U-shaped wraparound handle 102 secured to the upper end of handle 32. The wraparound handle is important to give the balance to the device 10 and necessary control to keep the machine going in a straight line. The wide, flat, uninterrupted surface of roller 12 which is wider than paper R is necessary to prevent tearing through the hot soft tar paper when hot tar is applied below the paper.

Means to clean the roller 12 generally comprises a brush 104 secured to a brush support 106 which is bolted or otherwise secured to ears 108 secured on connecting member 30. The brush 104 is in wiping contact with roller 12. A solvent such as kerosene is stored in container tank 110 having a filler cap 112 and an outlet 114. The outlet 114 is connected to a control valve 116 which controlls flow into a tee 118 connected to a distribution tube 120. The distribution tube 120 has a plurality of apertures approximately 1/16 inch in diameter formed along the length of the tube 120. The ends of the tube 120 are closed and the solvent flows from the tank 110 to tee 118 through the tube 120 onto the brush 104. The brush is saturated with the solvent to keep the surface of roller 12 free of tar and other debris.

Tank 110 is secured to support members 122 secured between frame 26 and support rod 38. Means to control the flow of solvent from the tank 110 to the brush 104 generally comprises a shielded cable 123 having a first end connected to valve control arm 124 and a second end connected to the handle 126 bolted or otherwise secured to the upper end of handle 32. Thus, the amount of solvent flowing onto the brush 104 may be controlled while using the device 10.

Figure 5:
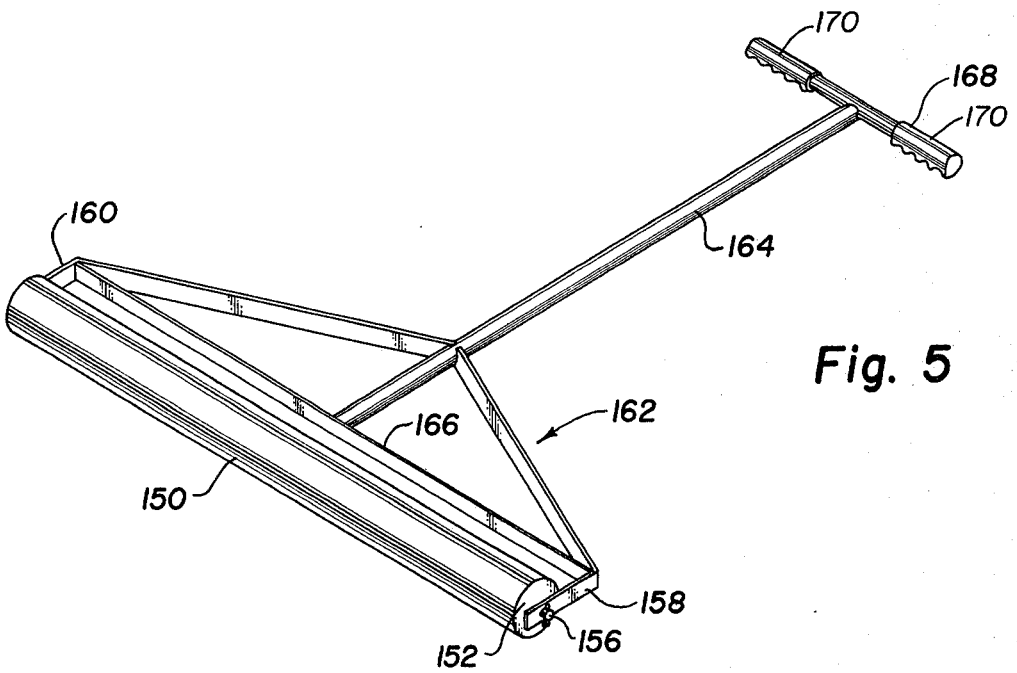
FIG. 5 is a perspective view of the tamper roller.

An alternate form of the tamper is illustrated in FIG. 5 and generally comprises a cylindrical roller 150 having end hubs 152 and bearings secured centrally therein. A shaft 156 is journaled through the bearings and apertures formed in the legs 158 and 160 of frame 162. The legs 158 and 160 are deflected inwardly and are secured to an upwardly extending handle 164 which is also secured to connecting member 166 between the legs 158 and 160. Handle 168 secured to handle 164 has a pair of hand grips 170 secured thereto. The roller 150 has a smooth, uninterrupted surface which rolls over the paper pressing it into place with a single smooth stroke.

It should be readily apparent from the foregoing that the invention accomplishes the objects of the invention hereinbefore discussed.

It should further be appreciated that other and further embodiments of the invention may be devised without departing from the spirit and scope of the invention as defined by the appended claims.

I claim:

1. A roller assembly for dispensing and applying felt paper comprising:

(a) a cylindrically shaped roller having a smooth, uninterrupted surface;

(b) a shaft journaled through said roller and extending outwardly therefrom to form an axle;

(c) frame means having a pair of legs joined by a connecting member with said shaft rotatably secured between said legs;

(d) handle means secured to said connecting member and extending upwardly therefrom;

(e) hand grips secured to said handle means;

(f) a pair of substantially conically shaped support rollers;

(g) means moveably supporting said support rollers in opposed positions on opposite sides of said frame means;

(h) control means for moving said support rollers from a first outer position to a second position wherein said support rollers engage the central hollow portion of a roll of felt paper and support said roll of felt paper between said support rollers;

(i) crank means pivotably secured to said frame means;

(j) connecting rods secured between said means moveably supporting said support rollers and said crank means to move said support rollers when said crank means is moved; and (k) means for moving said crank means.

2. A roller assembly as defined in claim 1 including brush means positioned adjacent said roller and adapted to clean said surface of said roller when said roller is rotated.

3. A roller assembly as defined in claim 2 including means for applying solvent to said brush means.

4. A roller assembly for dispensing and applying felt paper comprising:

(a) a cylindrically shaped roller having a smooth, uninterrupted surface;

(b) a shaft journaled through said roller and extending outwardly therefrom to form an axle;

(c) frame means having a pair of legs joined by a connecting member with said shaft rotatably secured between said legs;

(d) handle means secured to said connecting member and extending upwardly therefrom;

(e) hand grips secured to said handle means;

(f) a pair of substantially conically shaped support rollers;

(g) means moveably supporting said support rollers in opposed positions on opposite sides of said frame means comprising hinges pivotally secured between said frame means and said support rollers;

(h) control means for moving said support rollers from a first outer position to a second position wherein said support rollers engage the central hollow portion of a roll of felt paper and support said roll of felt paper between said support rollers;

(i) a support member secured between said legs of said frame means;

(j) a sleeve slideably arranged on each end of said support member with one of said hinges secured to each sleeve; and (k) means for adjustably securing said sleeves to said support member so that each sleeve and the hinge and support roller supported thereby may be adjustably moved along said support member.

* * * * *